United States Patent [19]

Reinitz

[11] 3,952,978

[45] Apr. 27, 1976

[54] CANTILEVER ARM SIGNAL ASSEMBLY

[75] Inventor: Willard O. Reinitz, Louisville, Ky.

[73] Assignee: Safetran Systems Corporation, Louisville, Ky.

[22] Filed: Sept. 19, 1974

[21] Appl. No.: 507,356

[52] U.S. Cl. ..... 246/477; 246/293; 340/332; 246/484; 238/10 R

[51] Int. Cl.[2] ..... B61L 5/12

[58] Field of Search ..... 246/273 R, 477, 484, 246/292, 293, 294; 340/334, 332; 40/125 R, 130; 238/10 R

[56] References Cited

UNITED STATES PATENTS

| | | | |
|---|---|---|---|
| 1,330,528 | 2/1920 | Hall | 246/484 |
| 1,435,807 | 11/1922 | Conley | 246/477 |
| 1,591,399 | 7/1926 | Nickell | 246/477 |
| 2,097,785 | 11/1937 | Field | 246/484 |

*Primary Examiner*—M. H. Wood, Jr.
*Assistant Examiner*—Richard A. Bertsch
*Attorney, Agent, or Firm*—Mattern, Ware, Davis & Stoltz

[57] ABSTRACT

A traffic crossing signal mast for railroad-highway grade crossings incorporates a sturdy cantilever arm extending over the highway and supporting a maintenance catwalk. A short, horizontal jury mast at the end of the cantilever arm is pivotable about its axis parallel to the highway direction through limited angular sectors of one-quarter turn clockwise and counterclockwise. A junction box assembly mounted at each end of the jury mast suspends a pair of warning flasher crossing signal lamps on each side of the catwalk aimed down the highway axis. Pivoting movement of the jury mast from its locked, detent position to a latched quarter-turned position raises one of each pair of signal lamps for initial cable connections, repairs or replacement of flashing lamp heads. A lockable clamping cam lever disengages the detent for jury mast rotation and re-engages it to secure the signal lamps in their aligned position for use. A novel catwalk-and-frame assembly is provided for ease of fabrication, incorporating aluminium chord extrusion frame members with integral concave ledges for supporting catwalk panels of expanded metal or perforated plates.

26 Claims, 19 Drawing Figures

13
14
15
31
41
34
33
27
32
28
24
29
23
19
16
18
38
42
11
12
17
26
36
39
37
4
12A
11A
61
66
5
43
44
45
48
20
21
22

CANTILEVER ARM SIGNAL ASSEMBLY

This invention relates to crossing signals for railroad-highway grade crossings, intersecting highways or other traffic control locations where permanent warning signal lamps are installed.

BACKGROUND OF THE INVENTION

Prior Art

Railroad grade crossing for one-lane or two-lane highways are customarily marked by warning flasher signal lights and a cross-buck "Railroad Crossing" sign, both mounted on a roadside post or mast. Servicing of such roadside signal lamps may be performed conveniently at the roadside, causing no interference with highway traffic.

Grade crossings for wider, multiple-lane highways require grade crossing signal lamps suspended over the highway approach lanes for maximum visibility. For stability, these suspended warning flasher lamps are customarily mounted permanently on cantilever arms projecting from roadside masts, minimizing wind-tossing of the signal lamps, and providing maximum directional stability for the installed flasher signal lamps.

Maintenance, repair or replacement of such over-the-highway, suspended flasher signal lamps require convenient access without interfering with normal traffic flow. This may be achieved by mounting the signal-supporting cantilever arm on the upper portion of a segmented two-part mast, with the parts joined together by a rotational bearing assembly, as in my U.S. Pat. No. 3,444,512, thus allowing the cantilever arm to be swung aside to a position beside the roadway where it may be reached from a cherry picker crane or an access ladder, permitting maintenance and lamp replacement without obstructing highway traffic in any way. U.S. Pat. No. 3,321,160 shows another rotating-mast cantilever arm signal device.

Non-rotatable cantilever arms can be serviced from temporary structures, cherry-picker vehicles or ladders standing in the roadway, but these block traffic and create the risk of accidents, To avoid these disadvantages, a catwalk may be mounted on the cantilever arm, providing access for maintenance personnel up the mast and across the catwalk to reach the lamps mounted at the remote end of the cantilever arm.

To minimize torsional vibratory effects caused by air circulation and oscillating multiple vortex formation under high wind conditions, risking torsional twisting and vibratory or fatigue failure of such cantilever signal mast structures, the signal lamp units presenting a comparatively large projected area or "windage" facing the wind direction are preferably mounted with their center of effort coinciding with the principal axis of the cantilever arm, thus tending to balance and streamline the structure and reduce such vibratory forces. Lamps positioned at this level are difficult to reach, being at or below the level of the catwalk, and requiring gymnastic contortions by the repair man reaching overboard to service the relatively heavy lamp structures.

SUMMARY OF THE INVENTION

These disadvantages are successfully overcome by the present invention, incorporating a light-weight, easily fabricated catwalk, with a short jury mast extending transversely at the end of the catwalk in the direction of the highway axis, and mounted for limited pivoting rotation about its own axis. Secured at both protruding ends of the jury mast are a pair of signal lamp assemblies mounted on junction box crossarms of conventional design.

A unique lockable detent assembly engages the jury mast and secures it in its normal operating mode position. The detent assembly journals the jury mast for limited pivoting rotation of about 90° in either direction from its operating mode position, thus rotating the crossarm junction box units through a sweep angle of about 90° to upright positions, exposing the signal lamp units mounted at their remote ends a foot or more above the catwalk level for convenient maintenance access. When maintenance is completed, the detent assembly is unlatched and the jury mast is returned to its operating mode position, and is locked in this position by the detent assembly.

It is therefore a principal object of this invention to provide relatively economical signal mast structures for supporting flasher signal lamps and similar traffic control signals directly over highways, grade crossings or other traffic control points.

Another object of the invention is to provide such traffic control signal masts affording convenient access to signal lamps mounted at the remote end of cantilever arms requiring no journal bearing mounting of the supporting heavy mast structure and thus eliminating the need for close manufacturing tolerances, lubrication and vandal proofing precautions for the signal mast structure itself.

A further object of the invention is to provide traffic control cantilever signal masts constructed as unitary, immovable stationary structures, minimizing wind deflection and vibratory displacement of signal lamps.

Another object of the invention is to provide easily fabricated and light-weight catwalk-and-frame assemblies.

Still another object of the invention is to provide cantilever arm signal mast structures supporting flasher traffic control signals incorporating pivoting jury mast support for the signal lamps positioned on the cantilever arm above a traffic roadway.

A further object of the invention is to provide such cantilever arm support masts for traffic control signal lamps affording limited angular sector rotational mounting capability for the lamp-supporting jury mast, permitting one of a pair of flasher lamps mounted at each end of the jury mast to be pivoted upward above the level of the cantilever arm, affording maintenance personnel convenient access to the signal lamps above the level of a catwalk mounted on the cantilever arm.

Other and more specific objects will be apparent from the features, elements, combinations and operating procedures disclosed in the following detailed description and shown in the drawings.

THE DRAWINGS

SPECIFIC DESCRIPTION

Figures 1, 2, 3, 4:
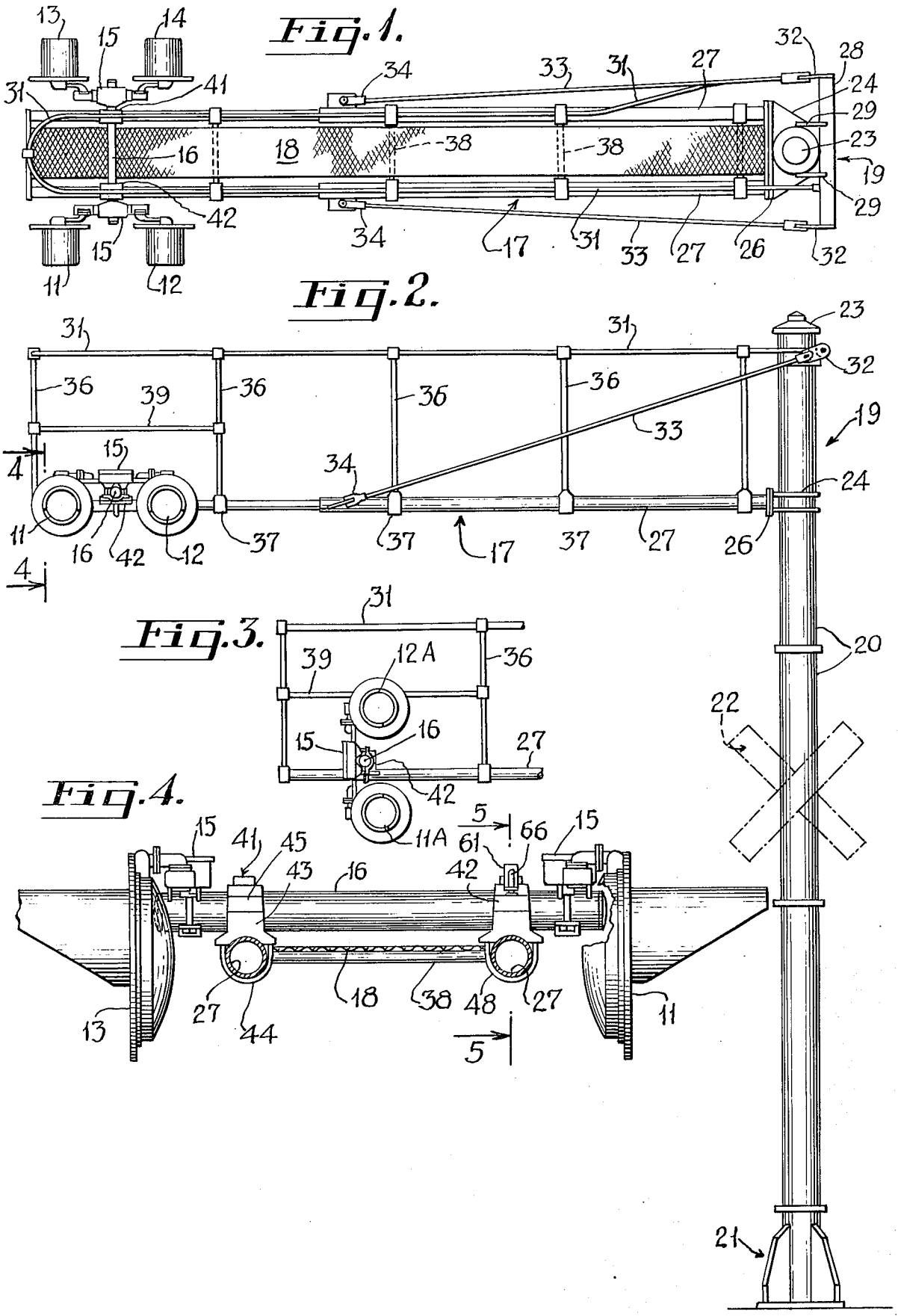
FIG. 1 is a top plan view of a cantilever arm signal mast for traffic control flasher signal lamps incorporating the present invention.
FIG. 2 is a front elevational view of the cantilever arm traffic control signal lamp mast structure of FIG. 1, showing the signal lamps in their operative mode position.
FIG. 3 is a fragmentary front elevation view of the signal lamps and a portion of their supporting cantilever arm, showing the lamps in their raised position for convenient access from the cantilever arm catwalk.
FIG. 4 is an enlarged cross-sectional end elevational view, taken along the plane 4—4 shown in FIG. 2, of the cantilever arm catwalk, showing the structural details of the signal lamp supporting assembly thereof.

The cantilever arm traffic control signal mast shown in FIGS. 1 and 2 incorporates the unique features of the present invention, combining sturdy, stable, over-the-roadway support for traffic control signal lamps on a firm, immovable mast structure, with convenient access afforded by the lamp supporting assembly for initial electrical connection, maintenance or replacement of parts from the cantilever arm catwalk of the support mast structure.

The pair of signal lamps 11 and 12 shown at the left hand side of FIGS. 1 and 2 are matched by a corresponding pair of signal lamps 13 and 14 facing in the opposite direction down a roadway axis, as shown in FIG. 1. Both pairs of signal lamps 11–12 and 13–14 are mounted on a crossarm junction boxes 15 and standard associated mounting conduit assemblies. Junction boxes 15 are clamped to a short jury mast 16 extending across the cantilever arm 17 and catwalk 18. Cantilever arm 17 forms the laterally extending superstructure of the signal mast generally indicated at 19, which incorporates a tall vertical mast column 20. The cantilever arm assembly 17 is sturdily clamped and bolted to the upper end of mast column 20, whose lower end is securely anchored to the ground by a mast base 21.

Mast column 20 may be formed, for example, of a sturdy thick wall tube of aluminum alloy 6061-T6, for example, with its upper end closed by a suitable weather proof cap 23.

If desired, the familiar cross-buck railroad crossing sign, or other traffic control signs or signals such as warning flashers or octagonal stop signs, may be mounted facing approaching traffic part way up the mast column 20, at the position shown in dash lines for cross-buck 22 in FIG. 2.

Firmly mounted near the upper end of mast column 20 by welding, bolting or the like are two supporting structures securing the cantilever arm 17 in position on column 20: a yoke 24 encircling column 20 and presenting a broad flat anchor plate 26 for abutting mounting of a pair of cantilever tubes 27 forming the principal frame members of cantilever arm 17; and a shoulder spar 28 extending parallel to the roadway axis above the level of cantilever tubes 27 and secured as by welding on the opposite side of column 20 from the cantilever arm 17, spar 28 may be secured to column 20 by welded flanges 29, for example; it provides an anchoring point for the column ends of hand rails 31, and it also provides sturdy outrigger end anchor points 32 for diagonal tension tie rods 33 whose outer ends are firmly secured by suitable clevis fittings to intermediate anchor points 34 positioned partway along the cantilever tubes 27 forming the principal frame members of the cantilever arm 17. Tubes 27 may be formed of telescoped tubular sections of progressively decreasing diameter for weight reduction as shown in FIGS. 1 and 2.

If desired, cantilever tubes 27 may be formed of aluminium extrusions having the cross-sectional shape shown in FIG. 12, and described in more detail below.

Hand rails 31 are supported by suitable posts 36 extending upward from anchor fittings 37 securing transverse braces 38 spanning the space between cantilever tubes 27, as shown in FIGS. 1 and 4, and thereby providing underlying support for the catwalk 18 formed of expanded metal or the like and extending substantially from the anchor plate 26 at mast column 20 to the outer end of the cantilever arm 17.

An additional mid level safety rail 39 may be installed encircling the outer end of cantilever arm 17 in the vicinity of the signal lamps 11–14, as shown in FIG. 2, to provide additional hand-holds and safety support for maintenance personnel working on the signal lamps near the outermost end of the cantilever arm 17.

ANGULARLY ROTATABLE JURY MAST ASSEMBLY

As shown in FIG. 4, a short, sturdy tubular jury mast 16 spans the catwalk 18 and extends beyond cantilever tubes 27 on both sides of the cantilever arms 17. Jury mast 16 is rotatably mounted in two journal fittings: an idler pivot assembly 41 U-bolted to one of the cantilever tubes 27, and a lockable detent assembly 42 U-bolted to the other cantilever tube 27 and shown in more detail in its two operating positions in FIGS. 5–8.

Idler pivot assembly 41 is formed essentially as a light-weight cast aluminum sleeve bearing, formed in two parts, a base 43 having laterally extending anchor flanges apertured for receiving a clamping U-bolt 44; and a mating cap 45 embracing the upper half of the tubular jury mast 16, and bolted to the base 43, as shown in FIG. 4.

U-bolted to each outer end of the tubular jury mast 16 is a junction box 15, with suitable conduit connectors joined to its outer ends supporting the pair of signal lamps 13 and 14 at the left side of FIG. 4, and signal lamps 11 and 12 at the right side of FIG. 4.

Figure 5:
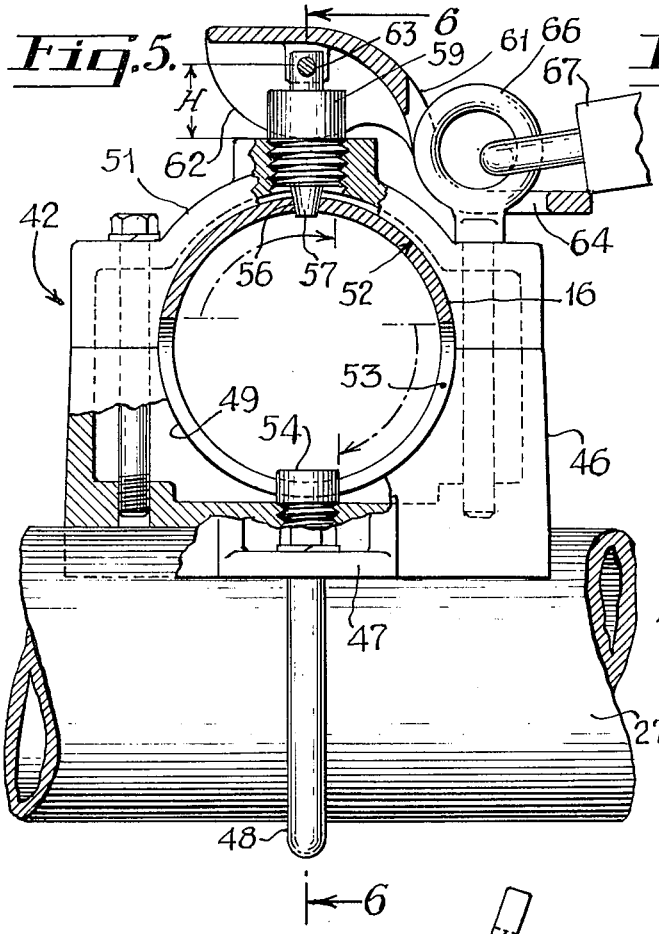
FIG. 5 is a greatly enlarged fragmentary cross-sectional front elevation view of the lamp support assembly taken along plane 5—5 shown in FIG. 4.

The lockable detent assembly 42 is similar in configuration to idler pivot assembly 41, incorporating a base 46 having apertured lateral ears 47 to which the threaded ends of U-bolt 48 encircling cantilever tubing 27 are bolted. The upper portion of base 46 is formed as a semi-circular trunnion cavity of bearing race 49 embracing the lower half of the tubular jury mast 16. A trunnion cap 51 incorporating a downwardly facing concave hemispherical bearing race portion 52 embraces the upper half of the tubular jury mast 16, and cap 51 is firmly bolted to the base 46, with the races 49 and 52 being aligned to encircle the jury mast 16, as shown in FIGS. 5 and 7.

The bases and caps of both the idler pivot assembly 41 and lockable detent assembly 42 may be formed, for example, of cast aluminum alloy 214, for extremely light weight and durability.

ANGULAR PIVOTING ROTATION OF THE JURY MAST

Figure 6:
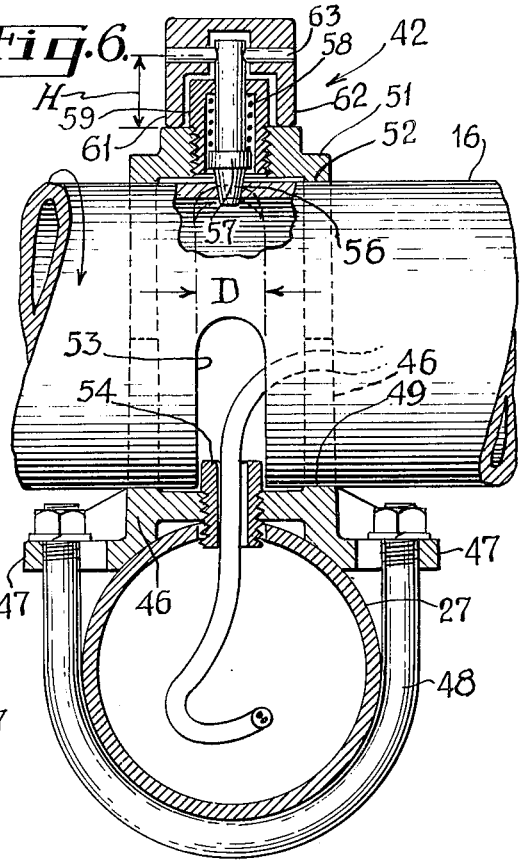
FIG. 6 is a corresponding greatly enlarged fragmentary cross-sectional end elevation view of the lamp support assembly shown in FIG. 5, showing the detent assembly camming handle in its engaged and locked, operative mode position.
Figure 7:
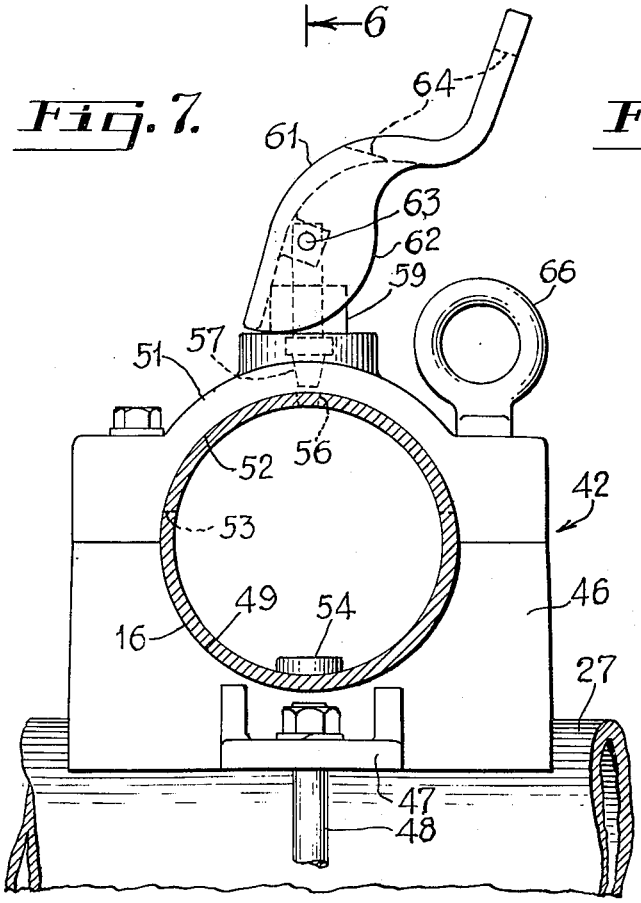
FIGS. 7 and 8 are greatly enlarged fragmentary front and end cross-sectional elevation views respectively corresponding to FIGS. 5 and 6, and showing the detent assembly camming handle in its raised, unlocked position, with the jury mast released ready for angular rotation about its own axis to bring the signal lamps to their raised access position.
Figure 8:
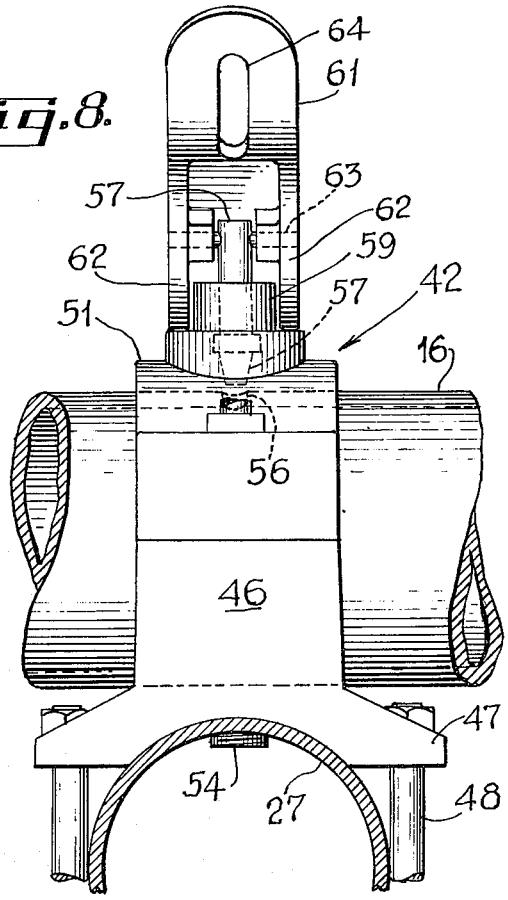

Being rotatably supported in the trunnion bearing mountings provided by the pivot assembly 41 and the lockable detent assembly 42, jury mast 16 is free to pivot about its own axis from the operating mode position shown in FIGS. 1, 2, 4, 5 and 6 through about 90° to the access mode position shown in FIGS. 3, 7 and 8 in which signal lamps 12 and 14 are raised above the level of cantilever tubes 27 to the position 12A shown in FIG. 3, for example.

In a similar manner, by revolving in the opposite direction, jury mast 16 may be rotated through an opposite arc of approximately 90° or one quarter turn, to bring signal lamps 11 and 13 to an uppermost position above the level of catwalk 18 and cantilever tubes 27 for convenient access by servicing personnel on catwalk 18, in a manner opposite to that shown in the drawings.

Several structural features of the lockable detent assembly serve to position and retain jury mast 16 in its desired axial orientation, and to limit the amount of its pivoting rotation to approximately one quarter turn in each direction.

A positioning slot 53 extends around a major portion of the periphery of the tubular jury mast 16 inside the lockable detent assembly 42, as shown in FIGS. 5 and 6. Slot 53 is formed with axial width D in the direction of the axis of the highway, and the parallel axis of the jury mast 16, as shown in FIG. 6, and width D is large enough to accomodate the outer diameter of a nipple 54 threaded into a tapped hole extending through the base 46 and protruding through an aligned hole into the interior of cantilever tube 27. Nipple 54 thereby forms a wiring portal for the threading of electrical conduit from the power line up mast column 20 and through cantilever tube 27 into the interior of jury mast 16 for connection via the junction boxes 15 to the signal lamps 11–14. In addition, the nipple 54 cooperates with the side walls of slot 53 to position jury mast 16 in an axial direction, retaining signal lamps 11–14 in the desired planes on each side of cantilever arm 17 and preventting jury mast 16 from drifting in an axial direction.

Slot 53 subtends an arcuate sector of the circumference of jury mast 16 of approximately 180° plus D, and the total angular movement from one extreme rotated position of jury mast 16, in which signal lamp 11 is uppermost for example, to the opposite extreme rotated position of jury mast 16 in which the lamp 12 is uppermost, is thereby limited to the arcuate sector determined by 180° plus D, or approximately 200°.

In each of these limiting positions, one end of slot 53 reaches abutting engagement with the nipple 54, preventing further rotation of jury mast 16. By this means, continuing rotation of jury mast 16 is prevented.

Midway around the remaining solid periphery of jury mast 16 in the plane of slot 53 is a detent aperture 56 tapered to receive a detent pin 57 as shown in FIGS. 5 and 7. Pin 57 is resiliently biassed downward into the detent aperture 56 by the action of a compressed coil spring 58, trapped in compression between an enlarged shoulder of pin 57 and a threaded spring housing 59 engaged in a tapped hole in the upper portion of trunnion cap 51, as shown in FIG. 6.

Spring 58 normally urges tapered detent pin 57 downward into engagement with detent aperture 56, securing jury mast 16 in its operating mode position, and preventing its angular rotation about its own axis as shown in FIG. 5. The upper end of detent pin 57 extends through a suitable opening in spring housing 59 for pivoting engagement with a camming handle 61 shown in FIGS. 5–8. Handle 61 is formed with a generally U-shaped or channel-shaped cross-section, with downwardly extending flanges 62 having a minimum height H from their lower edges to the axis of a pivot pin 63 joining the detent pin 57 to the handle 61.

Depending flanges 62 of handle 61 are provided with arcuate peripheral edges resembling sectors of a spiral or involute curve, as shown in FIGS. 5 and 7, and these have an increasing radius of curvature. Therefore as handle 61 is pivoted about the pivot pin 63 from its operating mode position shown in FIG. 5 to its access mode position shown in FIG. 7, the increasing height of flanges 62, being greater than the minimum height H, causes the lower edges of flanges 62 to engage and slide on the uppermost shoulder of lockable detent cap 51, raising pivot pin 63 from its normal position shown in FIGS. 5 and 6 to the raised position shown in FIGS. 7 and 8. The upward movement of pivot pin 63 compresses spring 58 and draws detent pin 57 upwardly, out of engagement with detent aperture 56 in jury mast 16, freeing the jury mast for angular pivoting rotation about its own axis.

Thus in the access mode condition shown in FIGS. 7 and 8, the jury mast 16 is free to rotate in either direction over an arc slightly greater than 90°, until the end of slot 53 engages the nipple 54. In each of these extreme rotated positions where one end of slot 53 engages nipple 54, the other end of slot 53 has revolved to a position just beyond detent pin 57. If handle 61 is allowed to return to its lowered, operating mode position, as shown in FIGS. 5 and 6, detent pin 57 descends into this opposite end of slot 53, as indicated in FIG. 6. Nipple 54 and detent pin 57 thereby secure the opposite ends of slot 53 between themselves, limiting the angular movement of jury mast 16.

With handle 61 in its lowered position, spring 58 biasses detent pin 57 into engagement with this slot 53, securing the raised signal lamp 12 in its upper access position 12A shown in FIG. 3, for example, and assuring that the signal lamp and jury mast assembly will not pivot downward inadvertently during servicing.

When servicing is completed, handle 61 may be raised to withdraw detent pin 57 from slot 53, and the jury mast 16 will then be free to rotate throughout its entire 200° sector of rotation if desired, bringing the oppositely offset signal lamps 11 and 13 into the uppermost access positions for further servicing. Thereafter, when servicing is completed, a final raising of handle 61 withdraws detent pin 57 from slot 53, releasing jury mast 16 for its angular pivoting return to its normal operating mode position, bringing slot 53 into the centered downward position shown in FIG. 5, with detent aperture 56 exposed upward for aligned engagement with detent pin 57, which automatically engages detent aperture 56 as spring 58 draws handle 61 from the uppermost position shown in FIG. 7 to the operating mode position shown in FIG. 5.

In the lowered position of handle 61 shown in FIGS. 5 and 6, a locking slot 64 formed in the free end of handle 61 receives the eye of a shouldered eye bolt 66 extending upward therethrough from cap 51 and serving as one of the bolts anchoring cap 51 to base 46. The eye of bolt 66 is thereby exposed to receive the hasp of a padlock 67 securing handling 61 in its lowered operating mode position, in which detent pin 57 is engaged in detent aperture 56, thus securing jury shaft 16 in its operating mode. When padlock 67 is unlocked and removed, handle 61 is free to swing upward to its raised position shown in FIGS. 7 and 8.

The idler pivot assembly 41 and the lockable detent assemby 42 thus secure jury mast 16 and signal lamps 11–14 firmly in their operating mode positions, but they provide readily-pivotable support affording free angular movement of the signal lamps to their raised access positions, holding them there firmly during servicing. In their operating mode position, the centers of effort of the laterally-exposed windage areas of lamps 11–14 are positioned on the level of the axes of cantilever tubes 27, minimizing air circulation vibratory effects, and tending to stabilize air flow patterns past the structure in high winds.

Since they are offset laterally slightly below the axis of jury mast 16 in opposite directions, each pair of signal lamps 11–12 and 13–14 tends to counter-balance itself, and also to swing downward to its operating mode position when released.

Being anchored near the outermost end of the fixed cantilever arm 17, the idler assembly 41 and detent assembly 42 assure the correct alignment and display of signal lamps 11–14, guaranteeing signal visibility down the highway axis for distantly approaching traffic. The rigid, sturdy, immovable support of arm 17 by mast column 20 eliminates the need for moving parts, and similarly assures continued signal visibility over a long useful life.

Figure 12:
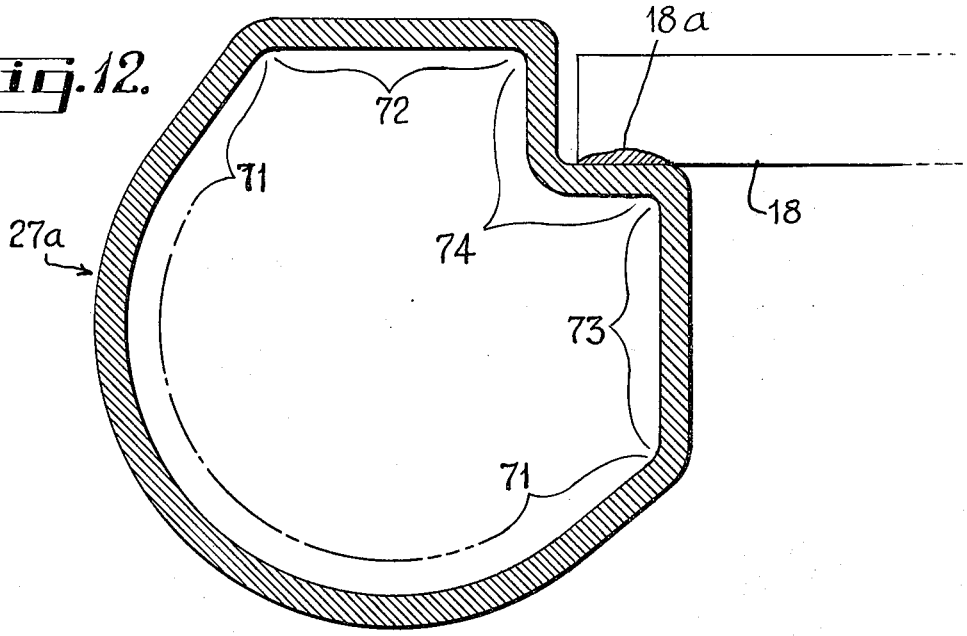
FIG. 12 is a greatly enlarged cross-sectional elevation view of the frame members thereof, taken along the plane 12—12 shown in FIG. 9.
Figure 13:
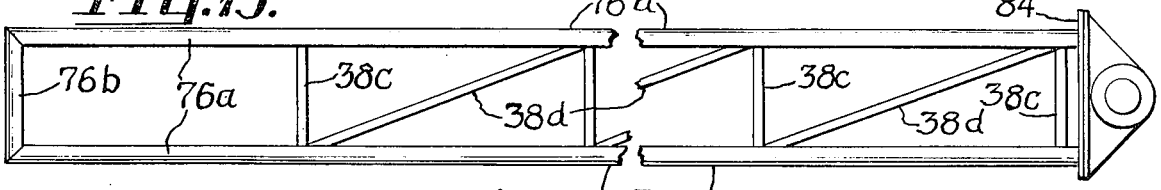
FIG. 13 is a top plan view of a modified catwalk-box-frame-mast assembly employed in another embodiment of the invention.
Figure 14:
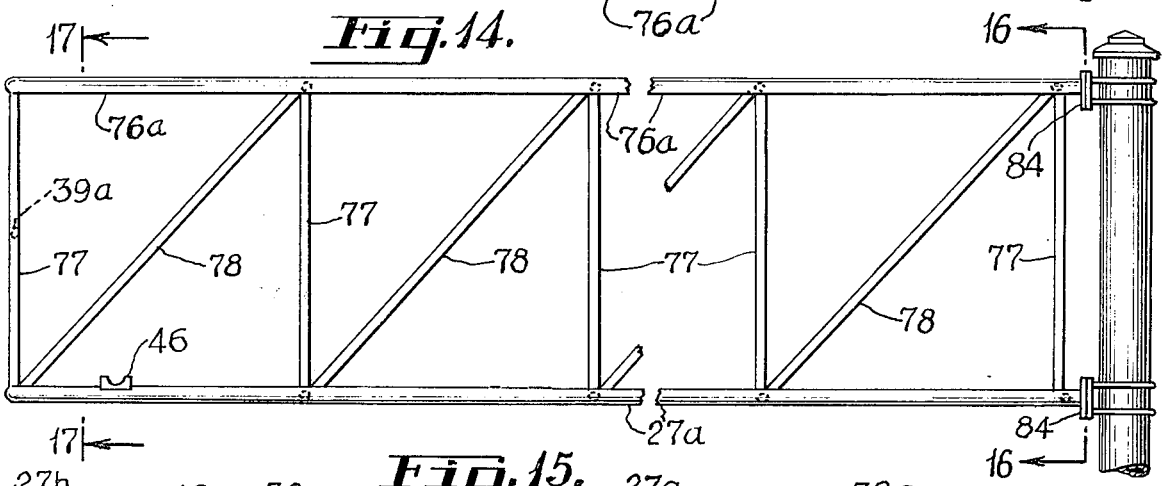
FIG. 14 is a side elevation view of the same catwalk-box-frame mast assembly.
Figure 15:
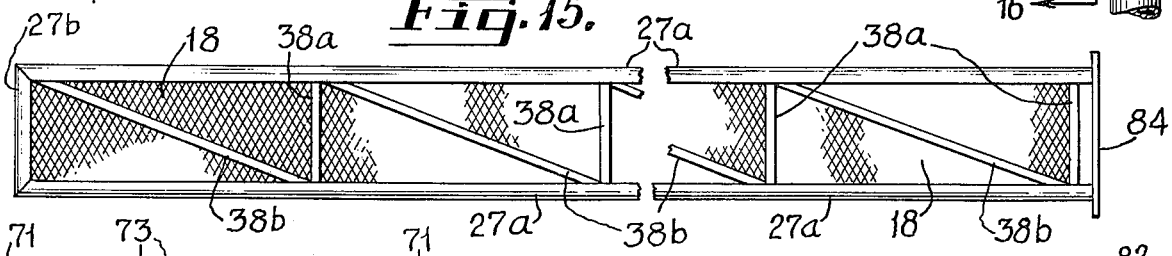
FIG. 15 is a bottom plan view of the catwalk-and-frame subassembly thereof.
Figure 17:
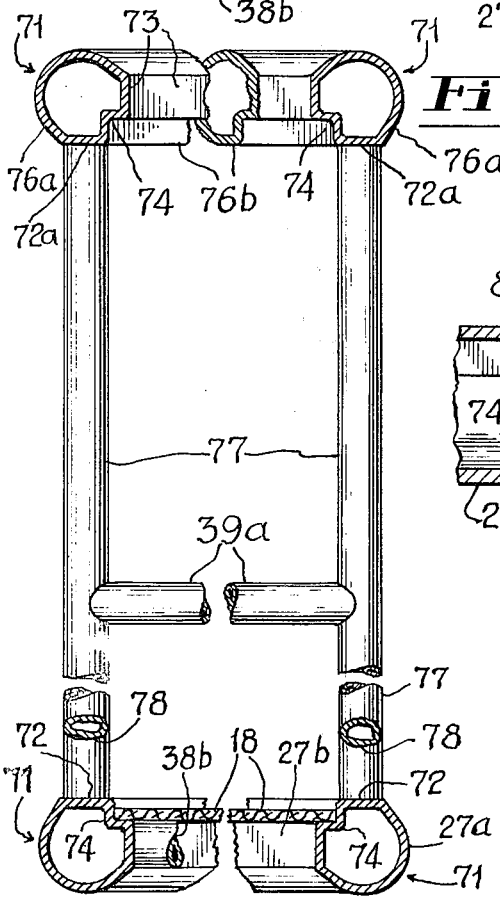
FIG. 17 is a cross-sectional end elevation view of the same assembly, taken along the plane 17—17 shown in FIG. 14.
Figure 16:
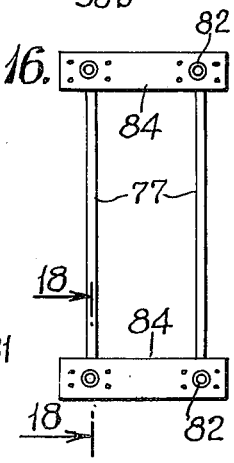
FIG. 16 is a rear end elevation view of the same catwalk-and-frame subassembly thereof, taken along the plane 16—16 shown in FIG. 14.

In the catwalk assembly shown in FIGS. 9–12, the cantilever tubes 27 are formed of 6061-T6 aluminum, extruded in the cross-section **27*a* of FIG. 12. Cross-section 27*a* incorporates a generally semi-circular supporting beam portion 71 whose ends merge into a substantially flat top portion 72 and a substantially vertical inside wall portion 73. The distal ends of portions 72 and 73 are joined by a bridging indented ledge portion 74, which may take the form of the right-angled L-shape shown in FIG. 12, incorporating a substantially flat horizontal shelf underlying the outer edge of catwalk panel 18**.

Panel 18 is preferably formed of light-weight expanded metal or perforated metal plate, and the edges of catwalk panel 18 are preferably welded at points **18*a* to ledge portion 74 of cantilever tube 27*a*** at intervals of four or five inches.

Figure 9:
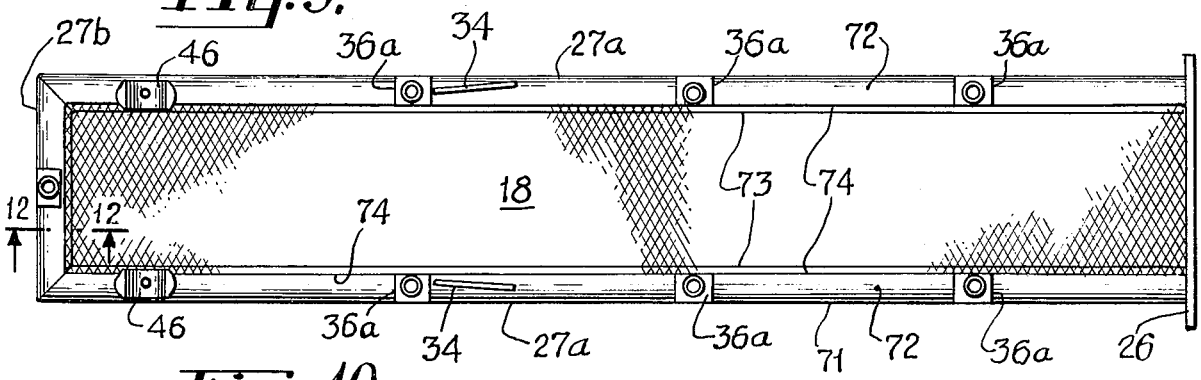
FIG. 9 is a top plan view of a catwalk-and-frame assembly employed in one embodiment of the invention.
Figure 10:
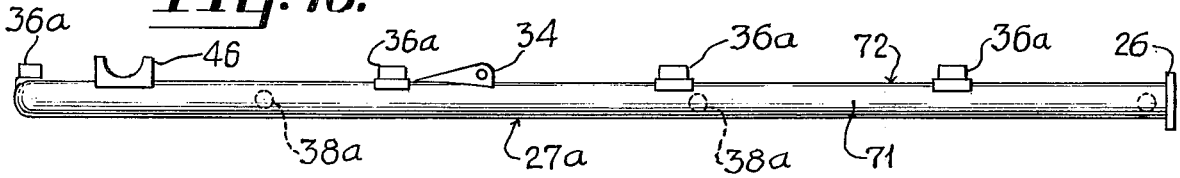
FIG. 10 is a side elevation view of the same catwalk-and-frame assembly.
Figure 11:
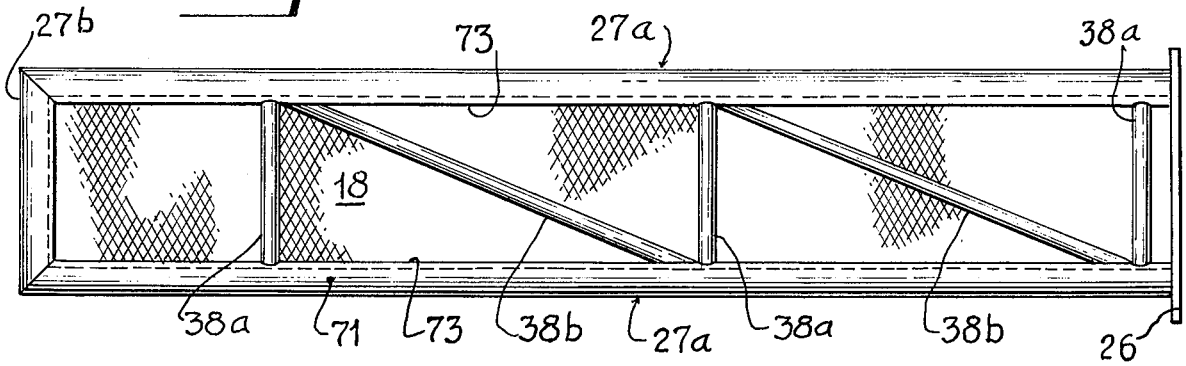
FIG. 11 is a bottom plan view of the same catwalk-and-frame assembly.

Flat top portion 72 provides firm stable support for welding the flat lower ends of handrail-supporting posts 36, or post anchoring sockets **36*a* (FIGS. 9 and 10). Flat inside wall portion 73 likewise accommodates for convenient welding the flat ends of transverse braces 38*a* and diagonal braces 38*b***.

A mitred outer end portion **27*b* of the same extruded tubular section may be installed at the free end of the catwalk assembly, welded between the mitred free ends of cantilever tubes 27*a*, providing a sturdy unitary frame encircling the catwalk 18, completed by anchor plate 26**.

Thus the structural features of the catwalk assembly of FIGS. 9–12 perform the same functions as in the catwalk assembly of FIGS. 1 and 2, while extruded tubular section **27*a* provides sturdy support for catwalk panel 18 and all associated members, achieving the advantages of strength, stiffness and extremely light weight. The extruded tube 27*a*** is easily fabricated, minimizing fabrication labor, custom fitting of mating parts, and stress concentration points in the completed catwalk assembly.

A modified embodiment of the catwalk-and-frame assembly of FIGS. 9–12 is shown in FIGS. 13–19. There the lower frame members **27*a* and 27*b* frame the catwalk 18 as before, braced by transverse struts 38*a* and diagonal braces 38*b*. Instead of handrails 31 on posts 36, however, a sturdy box truss beam structure is formed by an upper frame formed of similar extruded tubular chord members 76*a* and 76*b*, inverted to present their flat portions 72*a* facing downward toward the upward facing flat portions 72 of chord members 27*a* and 27*b*, embracing therebetween the flat ends of vertical tubular strut members 77 and diagonal tubular braces 78**.

As in the lower frame, the flat inside wall portions 73 of the upper tubular frame members **76*a* face each other, accomodating the flat ends of upper transverse struts 38*c* and diagonal braces 38*d***.

Figure 18:
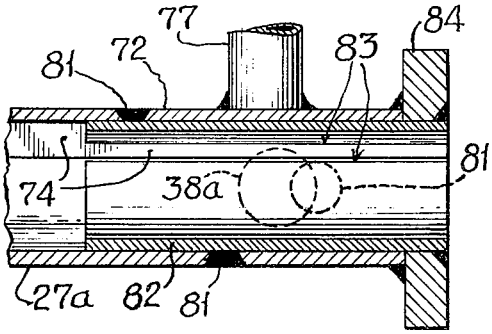
FIG. 18 is a greatly enlarged fragmentary cross-sectional side elevation view of the lower supporting corner of the catwalk-and-frame subassembly of FIGS. 15 and 16, taken along the plane 18—18 shown in FIG. 16.
Figure 19:
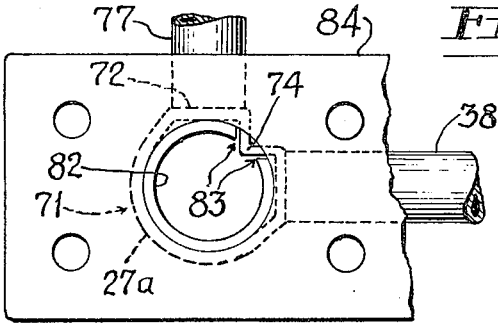
FIG. 19 is a rear end elevation view of the same structure shown in FIG. 18.

As shown in FIGS. 18 and 19, the rear ends of tubular chord members **27*a* and 76*a* are telescopingly engaged over and secured by spot welds 81 to anchor sleeves 82 having longitudinal slots 83 accomodating ledge portions 74, and extending beyond the free ends of the chord members into telescoped welded anchoring engagement with suitably apertured anchor plates 84** which are also in abutting and welded engagement with the free ends of the extruded chord members.

A mid level safety rail **39*a* spans the outer end of the structure, which thus forms a lightweight assembly of tubular beams, struts and braces welded at all joints to form a box truss beam of extreme sturdiness and rigidity, with the convexly curved outer surfaces 71 of all extruded chord members presenting streamlined faces to cross-winds, while flat portions 72 and 73** facilitate welding assembly. Cantilever walkways up to 40 feet long are readily constructed in this manner, with minimum deformation under snow, wind or pedestrian loads.

It will thus be seen that the objects set forth above, among those made apparent from the preceding description are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A traffic control signal assembly comprising a vertical mast column having a lower end anchored to a supporting base beside a traffic roadway, and a free upper end, a fixed cantilever arm extending laterally from the free upper end of the mast column above the traffic roadway, a fixed catwalk extending along the cantilever arm, and a transverse jury mast journalled at the free end of the cantilever arm above the catwalk, and supporting traffic control signal lamp means in offset operative mode position facing approaching traffic near the unsupported end of the arm, the jury mast being journalled for angular movement about its own axis relative to the fixed arm and the catwalk to swing the offset signal lamp means angularly upward above the catwalk level for convenient servicing access.

2. The traffic control signal assembly defined in claim 1, wherein the jury mast is angularly journalled above the level of the cantilever arm catwalk, and the signal means comprise at least one pair of traffic control lamps mounted side by side in oppositely offset positions beneath the axis of the jury mast and connected thereto by a crossarm junction box enclosing electrical power lines leading to the lamps, whereby the pair of lamps laterally counterbalance each other and tend to swing downward from their upper access position to an operative mode position in which both lamps are suspended substantially at the level of the cantilever arm catwalk.

3. The traffic control signal assembly defined in claim 1, wherein the cantilever arm catwalk is supported by two cantilever tubes each having one end anchored to the mast column and the other end providing support for the pivotally journalled jury mast.

4. The traffic control signal assembly defined in claim 3 wherein the cantilever tubes are formed of extruded material with the same non-circular cross section incorporating flat support portions presented to provide anchoring support for the other parts of the signal assembly.

5. The traffic control signal assembly defined in claim 3, wherein the cantilever tubes are formed with noncircular cross sections incorporating indented catwalk-embracing ledge portions underlying the edges of catwalk panel means spanning the space between the tubes.

6. The traffic control signal assembly defined in claim 3 wherein each of the cantilever tubes is formed with a non-circular cross-section incorporating a substantially flat wall portion facing inwardly toward the other of said tubes, presented to receive the ends of stiffening brace means spanning the space between the tubes.

7. The traffic control signal assembly defined in claim 3 wherein the cantilever tubes are formed of extruded material with non-circular cross sections incorporating flat support portions presented to provide anchoring support for the other parts of the signal assembly.

8. The traffic control signal assembly defined in claim 7, further including a short mitre-ended segment of said extruded tube material mounted between matinglymitred distal ends of the cantilever tubes, enclosing the free end of said catwalk.

9. The cantilever arm signal assembly defined in claim 3, further including a shoulder spar extending transversely to the direction of the cantilever arm and anchored to the side of the mast column opposite to and above the level of the cantilever tubes, and tie rod means extending diagonally downward from the shoulder spar to intermediate clevis means connected to the cantilever tubes, whereby the jury mast and signal lamp means are immovably held in position.

10. The cantilever arm signal assembly defined in claim 9, further including handrail means positioned above the level of the catwalk on supporting post means extending upward from the cantilever tubes.

11. The traffic control signal assembly defined in claim 10 wherein the cantilever tubes are formed with non-circular cross-sections incorporating upwardly-facing substantially flat top portions presented to receive the lower ends of the handrail-supporting post means.

12. The cantilever arm signal assembly defined in claim 1, wherein the jury mast is journalled in an idler pivot journal assembly and a lockable detent journal assembly, both journal assemblies being spaced apart along the axis of the jury mast.

13. The cantilever arm signal mast assembly defined in claim 12, wherein the lockable detent assembly incorporates a detent pin retractably engageable in a detent aperture formed in the periphery of the jury mast juxtaposed to the detent assembly, whereby the jury mast is normally locked in its operative mode position, and is released therefrom for angular movement to the lamp-raised access position by retraction of the detent pin from the detent aperture.

14. The cantilever arm signal mast assembly defined in claim 13, wherein the retractable detent pin is resiliently biassed into engagement with the detent aperture.

15. The cantilever arm signal mast assembly defined in claim 13, wherein the detent pin is pivotally connected to a camming handle incorporating involutely curved camming flange means having a minimum radius of curvature plane joining the pivot pin to the flange means zone of tangency with an underlying cam shoulder on the detent assembly when the detent pin is engaged and the handle is in a lowered position, whereby raising of the pivoted handle increases the distance from the shoulder to the pivot pin, withdrawing the detent pin from the detent aperture.

16. The cantilever arm signal mast assembly defined in claim 15, further including resilient means biassing the detent pin into engagement with the detent aperture.

17. The cantilever arm signal mast assembly defined in claim 15, further including locking means releasably securing the handle in its lowered position.

18. The cantilever arm signal mast assembly defined in claim 13, wherein the jury mast is also provided with a sector slot around a portion of its periphery embracing stop means protruding into the slot and preventing jury mast rotational movement beyond the ends of the sector slot.

19. The cantilever arm signal mast assembly defined in claim 18, wherein the jury mast is a hollow tubular mast and wherein the stop means comprising a nipple extending from the interior of the cantilever tube through the lockable detent assembly and the sector slot into the interior of the hollow jury mast, providing a wiring portal for power conductor cables leading to the signal lamp means.

20. The cantilever arm signal mast assembly defined in claim 18, wherein the nipple has a width D and wherein the sector slot width is greater than D, while the sector slot length extending partway around the peripheral circumference C of the jury mast comprises no less than $\frac{1}{2}C + D$, whereby the jury mast is enabled to revolve angularly about its own axis over a limited angle of approximately 200°.

21. The cantilever arm signal mast assembly defined in claim 20, wherein the rectractable detent pin removably engages the detent aperture formed in the jury mast in the plane of the peripheral sector slot and substantially midway between its ends, whereby the detent pin is aligned to engage either end of the sector slot when its other end is brought into abutting engagement with the stop means in a pivoted access position of the jury mast.

22. An elevated catwalk assembly structurally framed by a first pair of substantially parallel support tubes flanking and supporting light-weight catwalk panel means spanning the space between them, formed with non-circular cross-sections incorporating indented catwalk-embracing ledge portions underlying the edges of the catwalk panel means spanning the space between the tubes.

23. The elevated catwalk assembly defined in claim 22 wherein each of the tubes is formed with a non-circular crosssection incorporating a substantially flat wall portion facing inwardly toward the other of said tubes, presented to receive the ends of stiffening braced means spanning the space between the tubes.

24. The elevated catwalk assembly defined in claim 22 further including handrail means positioned above the level of the catwalk on supporting post means, wherein the cantilever tubes are formed with non-circular crosssections incorporating upwardly-facing substantially flat top portions presented to receive the lower ends of the handrail-supporting post means.

25. The elevated catwalk assembly defined in claim 23, further incorporating a second upper pair of substantially parallel support tubes spaced apart above said first pair of tubes to define the four longitudinal corner edges of a box beam, with each of said tubes having a substantially flat wall portion facing toward each next adjacent tube and presented to receive and anchor the ends of stiffening brace means spanning the spaces between tubes, thereby defining a box truss beam floored by said catwalk panel means, and having an open central core forming a pedestrian walkway.

26. The elevated box beam catwalk assembly defined in claim 25 wherein the four support tubes are all formed of extruded material having the same non-circular cross-section.

* * * * *